US009959998B2

(12) United States Patent
Hisada et al.

(10) Patent No.: US 9,959,998 B2
(45) Date of Patent: May 1, 2018

(54) SWITCH DEVICE

(71) Applicant: KABUSHIKI KAISHA TOKAI RIKA DENKI SEISAKUSHO, Aichi (JP)

(72) Inventors: Masahito Hisada, Aichi (JP); Makoto Kobayashi, Aichi (JP)

(73) Assignee: KABUSHIKI KAISHA TOKAI RIKA DENKI SEISAKUSHO, Aichi (JP)

( * ) Notice: Subject to any disclaimer, the term of this patent is extended or adjusted under 35 U.S.C. 154(b) by 0 days. days.

(21) Appl. No.: 15/171,201

(22) Filed: Jun. 2, 2016

(65) Prior Publication Data

US 2016/0358729 A1 Dec. 8, 2016

(30) Foreign Application Priority Data

Jun. 3, 2015 (JP) ..... 2015-113065

(51) Int. Cl.
*H01H 9/00* (2006.01)
*H01H 25/04* (2006.01)
*H01H 9/04* (2006.01)

(52) U.S. Cl.
CPC ..... *H01H 25/04* (2013.01); *H01H 9/04* (2013.01); *H01H 25/041* (2013.01);
(Continued)

(58) Field of Classification Search
CPC ..... H01H 25/04; H01H 9/04; H01H 25/041; H01H 2219/036; H01H 2231/026; H01H 2025/043
(Continued)

(56) References Cited

U.S. PATENT DOCUMENTS 5,510,810 A 4/1996 Nishijima et al.
6,777,633 B2 * 8/2004 Kondo ..... H01H 25/041 200/310
6,897,391 B2 * 5/2005 Gavalda ..... G05G 9/02 200/17 R

FOREIGN PATENT DOCUMENTS

DE 102012017122 A1 2/2013
EP 1426991 A1 6/2004
(Continued)

OTHER PUBLICATIONS

Extended European Search Report for corresponding European Patent Application No. 16172817.5 dated Oct. 12, 2016.
(Continued)

*Primary Examiner* — renee luebke
*Assistant Examiner* — Lheiren Mae A Caroc
(74) *Attorney, Agent, or Firm* — Roberts Mlotkowski Safran Cole & Calderon P.C.

(57) ABSTRACT

A switch device includes an operation part, a first push mechanism that, by a rotation operation of the operation part, selects and activates a first push switch part, a second push mechanism that, by a tilt operation of the operation part, activates a second push switch part, a circuit board including the first push switch part and the second push switch part mounted thereto, and a contact rubber interposed between the circuit board and the first and second push mechanisms. The contact rubber includes contacts corresponding to the first push switch part and the second push switch part and is configured such that the contacts contact with or separate from the corresponding switch parts by a movement of the first push mechanism and the second push mechanism. The contact rubber is formed so as to cover an entire upper surface of the circuit board.

6 Claims, 8 Drawing Sheets

(52) U.S. Cl.
CPC . *H01H 2025/043* (2013.01); *H01H 2219/036* (2013.01); *H01H 2231/026* (2013.01); *H01H 2237/006* (2013.01); *H01H 2300/012* (2013.01)

(58) Field of Classification Search
USPC ..... 200/4 A, 6 A, 6 R
See application file for complete search history.

(56) References Cited

FOREIGN PATENT DOCUMENTS

| | | | |
|---|---|---|---|
| JP | 06-150778 | A | 5/1994 |
| JP | 2004-071416 | A | 3/2004 |
| JP | 2011-175938 | A | 9/2011 |
| JP | 2013-196873 | A | 9/2013 |

OTHER PUBLICATIONS

Chinese Patent Application No. 201610348062.0 Office Action dated Sep. 29, 2017 and English translation thereof.
Japanese Patent Application No. 2015-113065 Office Action dated Dec. 19, 2017 and English translation thereof.

* cited by examiner

SWITCH DEVICE

The present application is based on Japanese patent application No. 2015-113065 filed on Jun. 3, 2015, the entire contents of which are incorporated herein by reference.

BACKGROUND OF THE INVENTION

1. Field of the Invention

The present invention relates to a switch device.

2. Description of the Related Art

Switch devices for controlling vehicle mirrors are known that can be used for selecting an electric mirror and adjusting a mirror surface angle of the electric mirror through the use of a single operation knob (refer to Patent Document 1, for example). Such a switch device can be used for selecting an electric mirror on the right side or the left side by a rotation operation of the operation knob and switching a switch circuit provided on the front surface of a circuit board in four ways by a tilt operation of the operation knob in a crisscross direction from a neutral position (refer to Patent Document 1, for example).

For example, in this switch device, a fixed contact constituting a four-way switch circuit is provided on the front surface of the circuit board provided inside a switch housing, and a fixed contact constituting another switch circuit is provided on the back surface of the circuit board. A push switch member having movable contacts is provided on the front surface of the circuit board, a rotation switch member including a movable contact is provided in a manner allowing for rotation on the back surface of the circuit board, and a rotation shaft extending through a shaft hole of the circuit board is integrally provided to the circuit board. A tip of an operation shaft of the operation knob is rotatably and tiltably engaged with a tip of the rotation shaft, and a push operation part that causes the movable contact of the push switch member to come into contact with the fixed contact of the circuit board by pushing the push switch member is integrally provided to the operation shaft. This configuration allows the selection of the left or right electric mirror and the adjustment of the mirror surface angle of the electric mirror through the use of a single operation knob.

CITATION LIST

Patent Document 1: JP-A-2004-71416

SUMMARY OF THE INVENTION

According to the switch device of Patent Document 1, the switch contacts used to select an electric mirror and adjust the mirror surface angle of the electric mirror are of the sliding contact type, resulting in a problematic poor operational feel due to the effects of sliding resistance. Further, the switch device is provided with the rotation shaft that extends through the shaft hole of the circuit board. Thus, it is difficult to make the circuit board waterproof due to the structure of the circuit board, resulting in difficulty in enhancing waterproofness.

It is an object of the present invention to provide a switch device that allows a switching operation and a switch operation in response to a rotation operation and a tilt operation of a single operation knob and has excellent operability and waterproofness.

[1] Provided is a switch device including a first push mechanism that, by a rotation operation of an operation part, selects and activates a first push switch part; a second push mechanism that, by a tilt operation of the operation part, activates a second push switch part; a circuit board having the first push switch part and the second push switch part mounted thereto; and a contact rubber interposed between the circuit board and the first push mechanism as well as the second push mechanism. In such a switch device, the contact rubber includes contacts corresponding to each of the switches, and is configured to cause a switch action upon each of the contacts coming into and out of contact with the corresponding switch by a movement of the first push mechanism or the second push mechanism and to cover an entire upper surface of the circuit board.

[2] The switch device may be the device described in [1] above, wherein the first push mechanism or the second push mechanism is a pusher that transmits a movement of the rotation operation or the tilt operation of the operation part as a push action to the circuit board.

[3] Further, the switch device may be the device described in [2] above, wherein the first push mechanism, by a rotation movement of a rod and a rotor caused by the rotation operation of the operation part, pushes a switching pusher via a cam portion of the rotor to move the switching pusher toward the circuit board; and the second push mechanism, by a tilt movement of the rod and an actuator caused by the tilt operation of the operation part, pushes a tilting pusher to move the tilting pusher toward the circuit board.

[4] Further, the switch device may be the device described in any one of [1] to [3] above, wherein a contact corresponding to the first push mechanism is provided between two or more contacts corresponding to the second push mechanisms.

[5] Further, the switch device may be constructed such that the contact rubber is formed so as to cover an entire side surface of the circuit board.

[6] Further, the switch device may be constructed such that the pusher comprises a plurality of pushers, and the contact rubber comprises a plurality of dome portions corresponding to the plurality of pushers so as to provide a resistance against the push action.

[7] Further, the switch device may be constructed such that the circuit board further comprises a light source, and the contact rubber comprises a transparent rubber for transmitting therethrough a light emitted from the light source.

Advantageous Effects of Invention

According to the present invention, it is possible to provide a switch device that allows a switching operation and a switch operation according to a rotation operation and a tilt operation of a single operation knob and has excellent operability and waterproofness.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

First Embodiment

Figure 1:
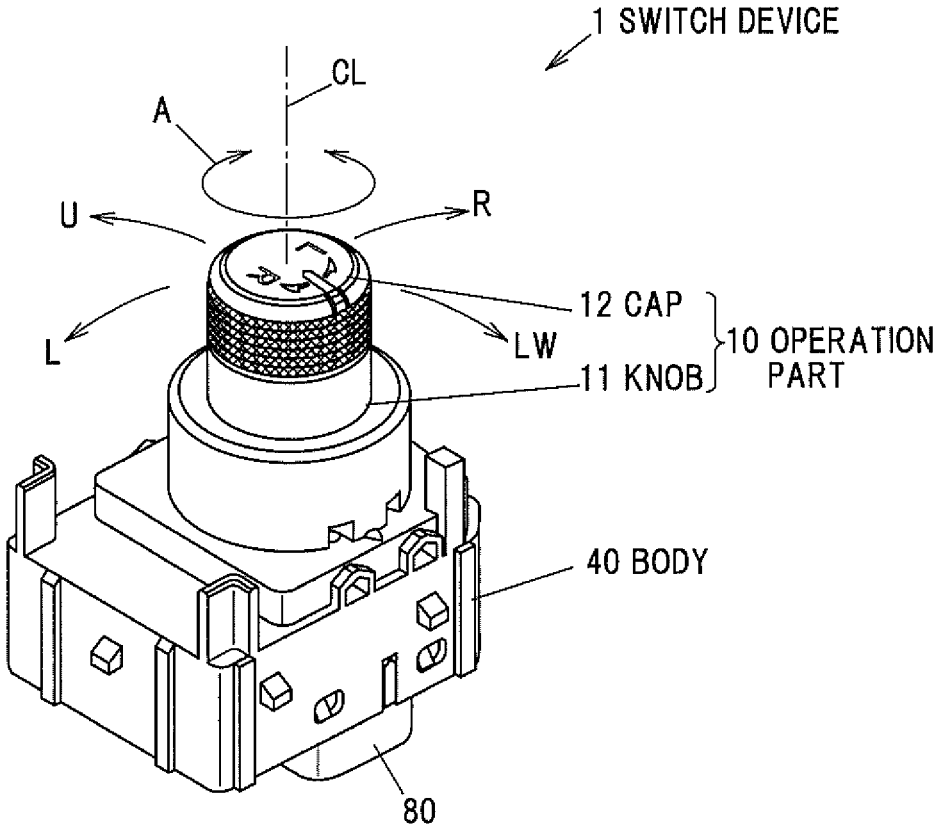
FIG. 1 is an overall perspective view of a switch device according to a first embodiment of the present invention.
Figure 2:
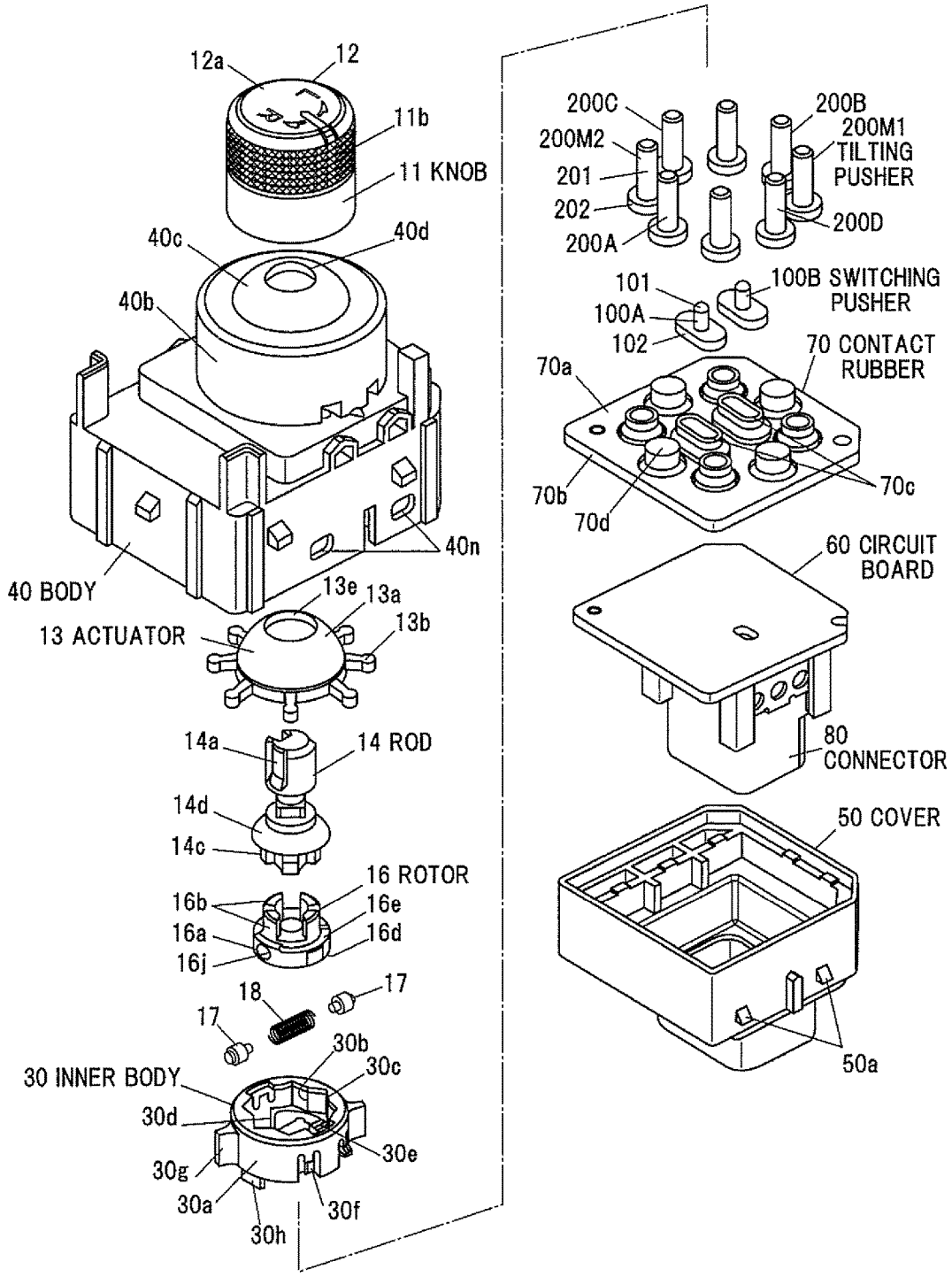
FIG. 2 is an exploded perspective view of the switch device according to the first embodiment of the present invention.
Figure 3:
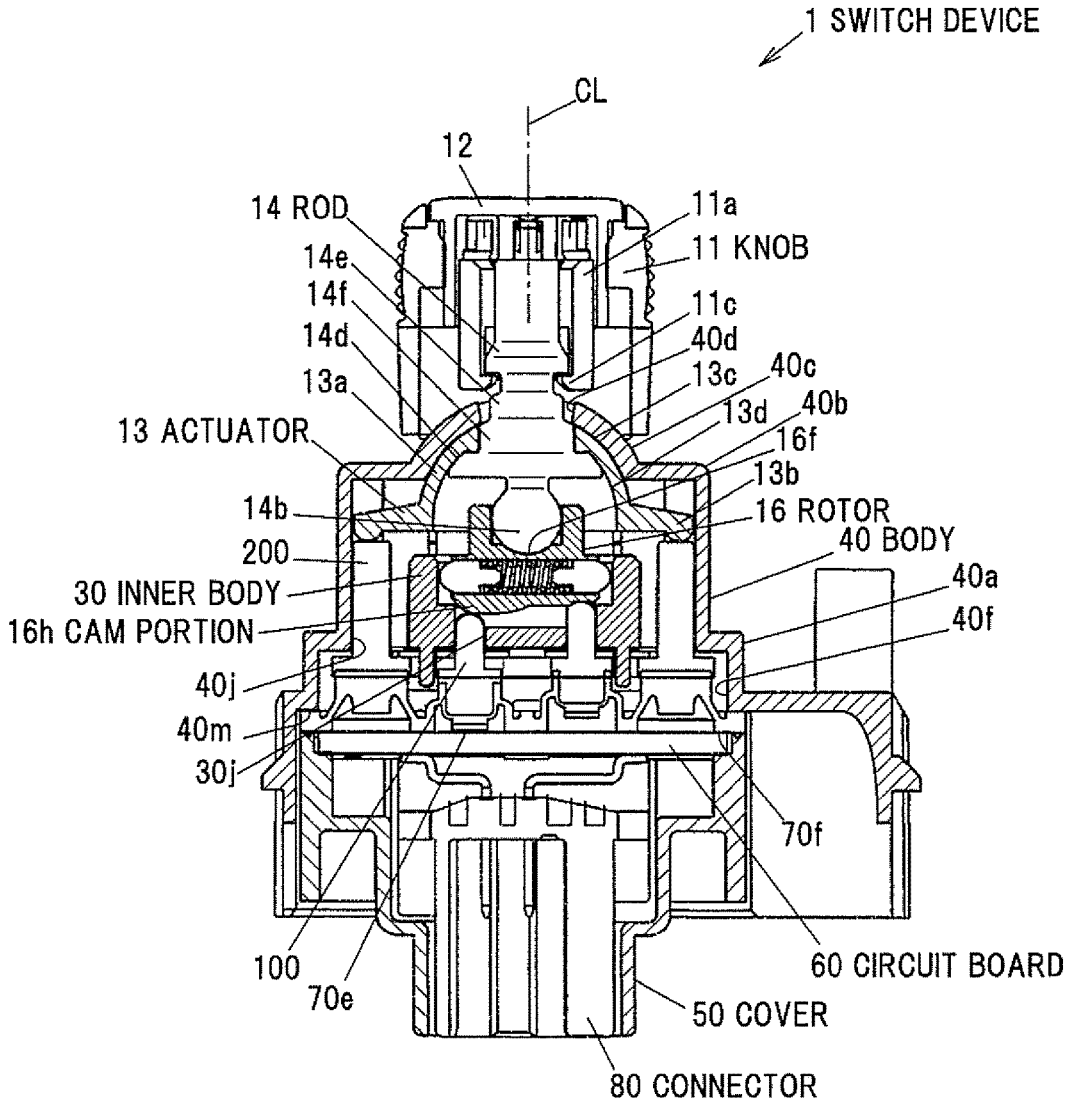
FIG. 3 is a longitudinal cross-sectional view of the switch device, including an operational axis CL, according to the first embodiment of the present invention.

FIG. 1 is an overall perspective view of a switch device according to a first embodiment of the present invention. FIG. 2 is an exploded perspective view of the switch device according to the first embodiment of the present invention. Further, FIG. 3 is a longitudinal cross-sectional view of the switch device, including an operational axis CL, according to the first embodiment of the present invention. A switch device 1 according to the first embodiment of the present invention includes a first push mechanism that, by a rotation operation of an operation part 10, selects and activates a first push switch part; a second push mechanism that, by a tilt operation of the operation part 10, activates a second push switch part; a circuit board 60 having the first push switch part and the second push switch part mounted thereto; and a contact rubber 70 that is interposed between the circuit board 60 and switching pushers 100 as well as tilting pushers 200 includes contacts corresponding to each of the switches, and is configured to cause a switch action upon each of the contacts coming into and out of contact with the corresponding switch by a movement of the switching pusher 100 or the tilting pusher 200. The contact rubber 70 is formed so as to cover an entire upper surface of the circuit board 60.

The switch device 1 according to the first embodiment of the present invention selects an operation target device by the first push switch part in response to the rotation operation of the operation part 10, and operates the selected device by the operation of the second push switch part in response to the tilt operation of the operation part 10, allowing switching by the rotation operation and a switch operation in the crisscross direction by the tilt operation through the use of a single operation knob. Further, the first push switch part and the second push switch part are not of the sliding type and are configured to be pushed by a pusher to bring contacts provided to the contact rubber 70 into and out of contact to perform a switch action, resulting in excellent operability. Further, the contact rubber 70 is formed so as to cover the entire upper surface of the circuit board 60, resulting in excellent waterproofness.

(Operation Part 10)

The operation part 10 outwardly includes a knob 11, a cap 12, and the like, as illustrated in FIG. 1. Further, as illustrated in FIG. 3, a cylindrical engaging projection portion 11*a* for fixing the knob 11 to the rod 14 is formed in the knob 11. The operation part 10 includes an actuator 13, a rod 14, and the like in addition to the knob 11 and the cap 12, and is configured to integrally tilt and rotate.

As illustrated in FIG. 1, the operation part 10 including the integrated knob 11 and the cap 12 allows a rotation operation around the operational axis CL (a direction A), and a tilt operation in a crisscross direction (a direction R (right), a direction L (left), a direction U (up), and a direction LW (down)) with respect to the operational axis CL.

The knob 11 and the cap 12 are, for example, formed of resin, metal, or the like.

(Knob 11)

The knob 11 and the cap 12 are integrated into the operation part 10 that is gripped by the fingers of an operator. The knob 11 has a cylindrical shape in which the cylindrical engaging projection portion 11*a* for fixing the knob 11 to the rod 14 is formed. A fitting portion 14*a* of a rod 14 described later is inserted into and fitted together with the engaging projection portion 11*a*, and fixed by a locking portion 11*c*, which is formed at a tip of the engaging projection portion 11*a*, so that the knob 11 does not separate from the rod 14.

Further, a portion 11*b* knurled by knurling is formed on a cylindrical portion of the substantially cylindrical knob 11 as a slip stopper for facilitating the rotation operation and the like when the knob 11 is gripped.

(Cap 12)

The rotation direction corresponding to the operation direction of this switch device 1 is indicated by arrows and letters 'L' and 'R' on an upper surface 12*a* of the cap 12. Note that these arrows, letters, and the like are written in white against a background print, allowing the arrows, letters, and the like to be illuminated by light irradiated from below.

(Actuator 13)

The actuator 13, as illustrated in FIGS. 2 and 3, includes, as main components, a semi-spherical shell-shaped spherical shell portion 13*a*, and push projection portions 13*b* that radially protrude from this spherical shell portion 13*a*, and is formed of resin or the like, for example. A spherical shell outer portion 13*c* of the spherical shell portion 13*a* is in contact with a body 40, and a spherical shell inner portion 13*d* is in contact with the rod 14. Further, an opening 13*e* having the rod 14 fitted together therewith and extending therethrough is formed in the center of the spherical shell portion 13*a*.

The push projection portions 13*b* that radially protrude in eight directions tilt and move downward by the tilt operation of the operation part 10, pushing the tilting pushers described later toward the circuit board. That is, tip positions of the push projection portions 13*b* are formed so as to correspond to the tilting pushers 200 (200A, 200B, 200C, 200D, 200M1, 200M2). Note that each of the push projection portions 13*b* is guided by a guide groove (not illustrated) of the body 40, allowing the push projection portions 13*b* to tilt, but not to rotate.

(Rod 14)

The rod 14 includes, on an upper portion thereof, the fitting portion 14*a* for being fitted together with the knob 11 and, on a lower portion thereof, a spherical surface portion 14*b* that is in contact with a rotor 16 (described later) to allow the rod 14 to tilt in any direction, and a projection portion 14*c* that is fitted together with the rotor 16 to allow the rod 14 to integrally rotate with the rotor 16. Further, the rod 14 has a stepped end 14*e* at the middle thereof. The stepped end 14*e* is in contact with a stopper opening 40*d* of the body 40 and defines a movable range of the rod 14 during the tilt operation. Note that, while this rod 14 is formed of resin or the like, formation by transparent resin allows the above-described arrows, letters, and the like to be illuminated by light, such as light from an LED positioned on a lower side, introduced to the upper surface 12*a* of the cap 12.

The rod 14, as illustrated in FIG. 3, includes a contact portion 14*d* that is in contact with the spherical shell inner portion 13*d* of the actuator 13. Further, a rotation shaft portion 14*f* is formed in correspondence with the opening 13*e* of the actuator 13. That is, the rod 14 is rotatably fitted together with the actuator 13 at the rotation shaft portion 14*f* and the contact portion 14*d*. On the other hand, when the rod 14 is tilted, the actuator 13 is tilted integrally with the rod 14 because the rotation shaft portion 14*f* and the opening 13*e* of the actuator 13 are fitted together.

(Rotor 16)

The rotor 16 is, for example, formed of resin, metal, or the like, and includes a substantially cylindrical main body portion 16*a*, and an engaging projection portion 16*b* that protrudes from this main body portion 16*a* in a direction in which the cylindrical main body portion 16*a* extends.

The engaging projection portion 16*b* engages with the projection portion 14*c* of the rod 14 in the rotation direction. This configuration allows the rotation by the rotation operation of the knob 11 to be transmitted to the rotor 16 via the rod 14. Note that the engaging projection portion 16*b* of the rotor 16 and the projection portion 14*c* of the rod 14 are not regulated in terms of movement in the vertical direction, allowing movement in the vertical direction (slight movement) during the tilting action.

A lower surface end 16*d* of the main body portion 16*a* comes into contact with a bottom portion 30*d* of an inner body 30, thereby positioning the rotor 16 in the vertical direction as illustrated in FIGS. 2 and 3. Further, an upper surface end 16*e* of the main body portion 16*a* comes into contact with a holding portion 30*e* of the inner body 30, thereby preventing the rotor 16 from separating upward and locking the rotor 16. This configuration causes the rotor 16 to be positioned in the vertical direction and to be rotatably supported with respect to the inner body 30. In the main body portion 16*a*, a through-hole 16*j* is formed extending in a direction orthogonal to the rotational axis, into which detent pushers 17 are slidably housed.

On a lower end surface of the main body portion 16*a*, a cam portion 16*h* is formed in a cam shape and protrudes downward. A lower surface of this cam portion 16*h* is in contact with upper end portions of the switching pushers 100 described later, and is capable of moving one of the switching pushers 100 (100A, 100B) downward in response to the rotation of the rotor 16.

As illustrated in FIG. 3, a receiving surface portion 16*f* that receives the spherical surface portion 14*b* of the rod 14 is formed on an upper side of the main body portion 16*a*. This receiving surface portion 16*f* is formed in a concave spherical surface shape corresponding to the spherical surface portion 14*b* of the rod 14. This configuration allows the knob 11, the cap 12, the actuator 13, and the rod 14 to be tilted in the four directions (crisscross direction) including the direction R (right), the direction L (left), and the direction U (up), and the direction LW (down).

(Inner Body 30)

The inner body 30 is, for example, formed of resin, metal, or the like, and includes a substantially cylindrical main body portion 30*a* in which a housing portion 30*b* for housing the rotor 16 is formed. A detent groove 30*c* is formed on an inner cylindrical surface of the housing portion 30*b*, and is configured so that the detent pushers 17, which are biased by a spring 18 to protrude from the main body portion 16*a*, come into contact with the detent groove 30*c*, allowing the rotor 16 described above to give a detent feeling.

In the housing portion 30*b* is formed the bottom portion 30*d* with which the lower surface end 16*d* of the rotor 16 comes into contact to be positioned in the vertical direction. Two guide holes 30*j* configured to guide the switching pushers 100 are formed in this bottom portion 30*d*, as illustrated in FIG. 3. Further, the holding portion 30*e* that holds the upper surface end 16*e* of the rotor 16 is formed to prevent the rotatably housed rotor 16 from separating in the rotational axis direction.

On an outer cylindrical surface of the main body portion 30*a* is formed two projection portions 30*g* that are housed in the body 40 described later and positioned facing each other (positioned 180° apart from each other). These projection portions are configured to position the inner body 30 and regulate the rotation of the inner body 30 in the rotational axis direction. In addition, a pawl portion 30*f* for fixing the inner body 30 housed in the body 40 is formed on the inner body 30. Furthermore, a guide wall 30*h* that serves as a rotation stopping guide when the switching pushers 100 described later move downward is provided to the inner body 30.

(Body 40)

As illustrated in FIGS. 2 and 3, the body 40 is formed of resin, metal, or the like, and includes a box-shaped main body portion 40*a* having a space portion 40*f* that houses the circuit board 60, the contact rubber 70, the switching pushers 100, the tilting pushers 200, and the like, a support portion 40*b* formed in a cylindrical shape on an upper portion of the main body portion 40*a*, and a dome portion 40*c* formed in a dome shape, extending upward from this support portion 40*b*.

The dome portion 40*c* is rotatably in contact with the spherical shell outer portion 13*c* of the actuator 13. That is, the dome portion 40*c* has the same curvature as that of the spherical shell outer portion 13*c* so as to rotatably support the actuator 13 during the tilt operation. Further, the stopper opening 40*d* that defines the tilting range of the stepped end 14*e* of the rod 14 is formed in the center of the dome portion 40*c*.

Furthermore, as illustrated in FIG. 3, in the support portion 40*b* is formed guide holes 40*j* extending through in the direction of the operational axis CL, the guide holes 40*j* being configured to guide the tilting pushers 200.

Further, as illustrated in FIG. 3, the circuit board 60 and the contact rubber 70 are housed in the space portion 40*f* of the main body portion 40*a*, and fixed by a cover 50 from below. An upper surface 60*a* of the circuit board 60 and an inner ceiling portion 70*f* of the contact rubber 70 come into contact with each other, and the circuit board 60 and the contact rubber 70 are pressed and fixed by the cover 50 from below with an upper surface portion 70*a* of the contact rubber 70 in contact with an inner stage portion 40*m* of the space portion 40*f*.

(First Push Mechanism)

The first push mechanism is a mechanism that, by the rotation operation of the operation part 10, selects and activates the first push switch part. The first push mechanism includes the operation part 10 (the knob 11, and the cap 12), the rod 14, the rotor 16, the switching pushers 100, and the like described above. Here, the first push switch part is a contact pattern formed on the circuit board 60 described later. The contact pattern is configured to be on/off on the basis of the rotation operation.

The switching pushers 100 (100A, 100B) each include a shaft portion 101 and a push operation portion 102 that pushes the first push switch part via the contact rubber 70. The shaft portions 101 are slidably guided by the guide holes 30*j* of the inner body 30. The switching pushers 100 (100A, 100B) are biased toward the rotor 16 by the elastic force of the contact rubber 70. The switching pusher 100A or 100B is pushed toward the circuit board 60 against the elastic force of the contact rubber 70 by the cam portion 16*h* of the rotor 16 in response to the rotation operation of the operation part 10.

(Second Push Mechanism)

The second push mechanism is a mechanism that, by the tilt operation of the operation part 10 (the knob 11 and the cap 12), selects and activates the second push switch part, and includes the operation part 10, the actuator 13, the rod 14, the tilting pushers 200, and the like described above. Here, the second push switch part is a contact pattern formed on the circuit board 60 described later. The contact pattern is configured to be on/off on the basis of the rotation operation.

The tilting pushers 200 (200A, 200B, 200C, 200D, 200M1, 200M2) each include a shaft portion 201 and a push operation portion 202 that pushes the second push switch part via the contact rubber 70. The shaft portions 201 are slidably guided by the guide holes 40*j* of the body 40. The tilting pushers 200 (200A, 200B, 200C, 200D, 200M1, 200M2) are biased toward the actuator 13 by the elastic force of the contact rubber 70. The tilting pushers (200A, 200B, 200C, 200D, 200M1, 200M2) on the tilted side are each pushed toward the circuit board 60 against the elastic force of the contact rubber 70 by the corresponding push projection portion 13*b* of the actuator 13 in response to the tilt operation of the operation part 10.

(Circuit Board 60)

Figure 4:
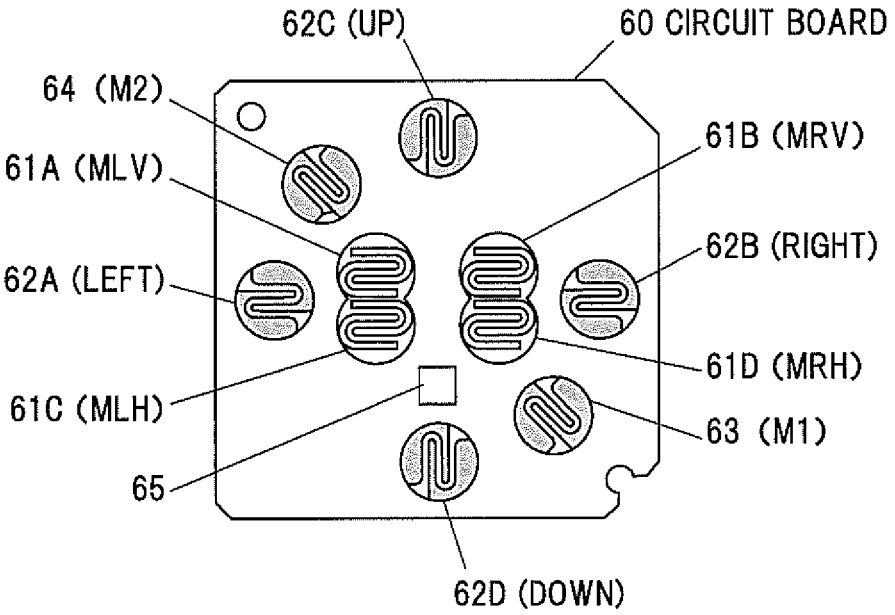
FIG. 4 is a plan view of an example of a contact pattern of a circuit board of the switch device according to the first embodiment of the present invention.

FIG. 4 is a plan view of an example of the contact pattern of the circuit board of the switch device according to the first embodiment of the present invention. The circuit board 60 is obtained by forming a contact pattern on a board made of epoxy, glass epoxy, ceramic, or the like, and forming a required wiring pattern, a land for element mounting, and the like, and is provided with connectors and the like as necessary. A connector 80 for wiring can be led out from any position of the cover, and is connectable to a vehicle harness. Note that the example of the contact pattern of the circuit board illustrated in FIG. 4 is only a contact pattern, and the wiring pattern, land, and the like are omitted.

The first push switch part is a contact pattern formed on the circuit board 60. The contact pattern is configured to be on/off on the basis of the rotation operation. As illustrated in FIG. 4, the first push switch part includes contacts 61A, 61B, 61C, 61D formed on the circuit board 60. The contacts (61A, 61B, 61C, 61D) corresponding to this first push mechanism are disposed between two or more contacts (62A, 62B, 62C, 62D, 63, 64) corresponding to the second push mechanism described later. Here, each of the contacts 61A, 61B, 61C, 61D is brought into conduction and switched on by a contact plate 70*e* of the contact rubber 70, which is positioned over the corresponding contact, being pushed by the switching pusher 100 (100A, 100B).

The second push switch part is a contact pattern formed on the circuit board 60. The contact pattern is configured to be on/off on the basis of the tilt operation. As illustrated in FIG. 4, the second push switch part includes the contacts 62A, 62B, 62C, 62D, 63, 64 formed on the circuit board 60. Here, each of the contacts 62A, 62B, 62C, 62D, 63, 64 is brought into conduction and switched on by the contact plate 70*e* of the contact rubber 70, which is positioned over the corresponding contact, being pushed by the tilting pusher 200 (200A, 200B, 200C, 200D, 200M1, 200M2).

(Contact Rubber 70)

The contact rubber 70 is formed of an elastomer (rubber) such as silicone, in which the upper surface portion 70*a*, side surface portions 70*b*, and dome portions 70*c*, 70*d* formed in a convex shape in correspondence with the first push switch part and the second push switch part are integrally formed. This contact rubber 70, as illustrated in FIG. 3, is mounted so as to cover the circuit board 60 with the upper surface portion 70*a* and the dome portions 70*c*, 70*d*, and enclose all side surfaces of the circuit board 60 with the side surface portions 70*b*. The dome portions 70*c*, 70*d* are formed corresponding to the switching pushers 100 (100A, 100B) and the tilting pushers 200 (200A, 200B, 200C, 200D, 200M1, 200M2), and bias each of the pushers by the elastic force of the rubber toward the operation part 10, resulting in resistance against the push action.

As illustrated in FIG. 3, the conductive contact plates 70*e* are each mounted on the lower end portion of each of the dome portions. Thus, each of the pushers moves downward by the rotation operation or the tilt operation to cause the contact plate 70*e* to come into contact with the corresponding contact (61A, 61B, 61C, 61D, 62A, 62B, 62C, 62D, 63, 64) positioned on the circuit board 60, bringing the contact into conduction and causing the on action of the switch to be performed.

(Assembly)

The assembly procedure for each of the components described above will be briefly described with reference to FIGS. 2 and 3. First, the actuator 13, the rod 14, the rotor 16, and the inner body 30 are inserted into the space portion 40*f* of the body 40 from below in FIG. 2. Note that the detent pushers 17 and the spring 18 are preassembled in the through-hole 16*j* of the rotor 16. The projection portion 14*c* of the rod 14 is fitted between the engaging projection portions 16*b* of the rotor 16. Further, the projection portions 30*g* of the inner body 30 are positioned in positioning holes (not illustrated) of the body 40. In this state, the pawl portion 30*f* of the inner body 30 is fitted together with and fixed to an engaging portion (not illustrated) of the body 40.

The switching pushers 100 are inserted into the guide holes 30*j* of the inner body 30, and the tilting pushers 200 are inserted into the guide holes 40*j* of the body 40. In this state, the contact rubber 70 and the circuit board 60 are fixed while being pushed by the cover 50 from below toward the body 40. Pawl portions 50*a* of the cover 50 are fitted into locking holes 40*n* of the body 40 and fixed. Note that the connector 80 and the like are mounted in advance on the circuit board 60.

(Circuit Configuration)

Figure 5:
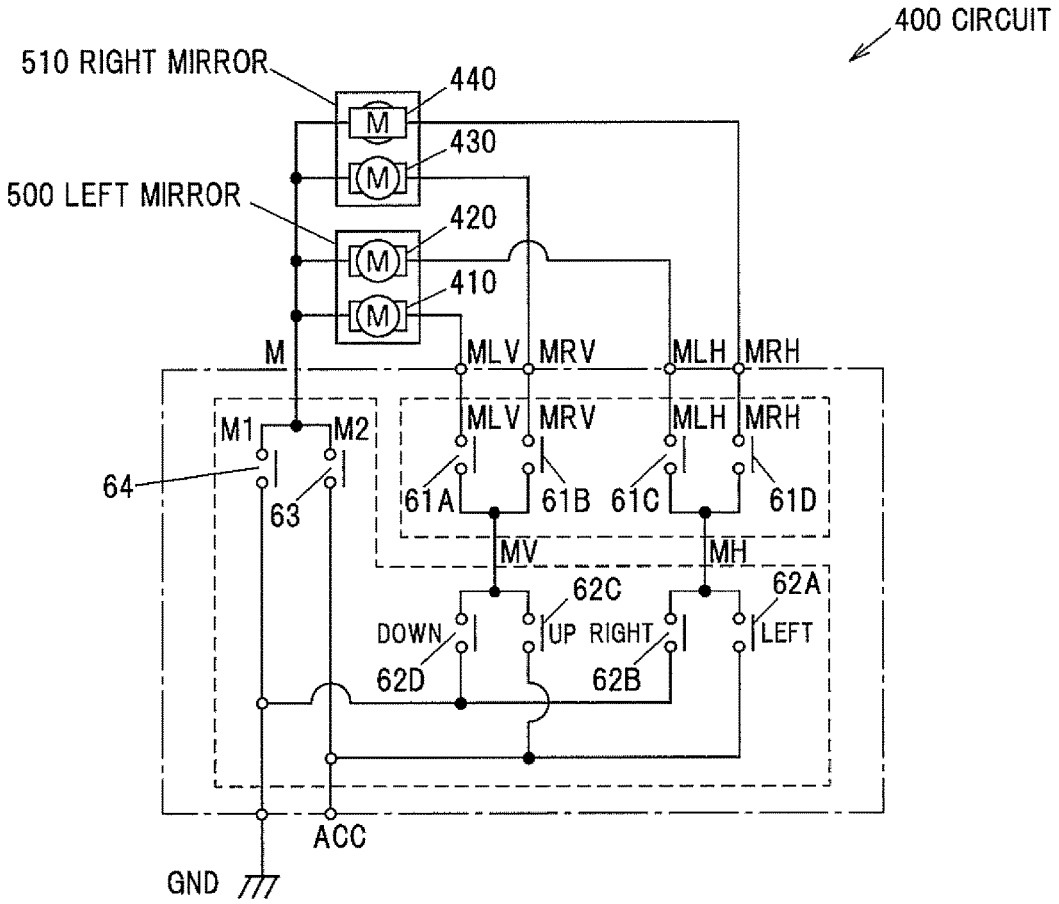
FIG. 5 is a circuit diagram illustrating an example of a switch circuit of the switch device according to the first embodiment of the present invention.

FIG. 5 is a circuit diagram illustrating an example of a switch circuit of the switch device according to the first embodiment of the present invention. This circuit 400 is an example of a circuit for controlling electric mirrors for a vehicle, for example. The circuit 400 is configured to select a left or a right mirror according to the rotation operation of the operation part and to tilt the selected mirror in the up, down, left, or right direction according to the tilt operation of the operation part.

Motors 410, 420 for tilting a mirror in the horizontal direction and the vertical direction are mounted to a left mirror 500. Further, motors 430, 440 for tilting a mirror in the horizontal direction and the vertical direction are mounted to a right mirror 510.

As illustrated in FIG. 5, one end of the motor 410 of the left mirror 500 is connected to a ground (GND) via the contact 64 and to an accessory (ACC) power supply via the contact 63. Further, the other end of the motor 410 is connected to the contact 61A, and the other end side of the contact 61A is connected to the contact 62D connected to the ground (GND) and to the contact 62C connected to the ACC power supply.

One end of the motor 420 of the left mirror 500 is connected to the ground (GND) via the contact 64, and to the ACC power supply via the contact 63. Further, the other end of the motor 420 is connected to the contact 61C, and the other end of the contact 61C is connected to the contact 62B connected to the ground (GND) and to the contact 62A connected to the ACC power supply.

Further, one end of the motor 430 of the right mirror 510 is connected to the ground (GND) via the contact 64 and to the ACC power supply via the contact 63. Further, the other end of the motor 430 is connected to the contact 61B, and the other end of the contact 61B is connected to the contact 62D connected to the ground (GND), and to the contact 62C connected to the ACC power supply.

One end of the motor 440 of the right mirror 510 is connected to the ground (GND) via the contact 64 or to the ACC power supply via the contact 63. Further, the other end of the motor 440 is connected to the contact 61D, and the other end side of the contact 61D is connected to the contact 62B connected to the ground (GND) and to the contact 62A connected to the ACC power supply.

The contacts brought into conduction by the rotation operation are either the contacts 61A, 61C or the contacts 61B, 61D.

The contact brought into conduction by the tilt operation is one of the contacts 62A, 62B, 62C, 62D. Further, the contact 64 is brought into conduction when the contact 62A or the contact 62C is brought into conduction. Furthermore, the contact 63 is brought into conduction when the contact 62B or the contact 62D is brought into conduction.

(Action by Rotation Operation of Switch Device 1)

The rotation operation of the operation part 10 is to select one of the left mirror 500 and the right mirror 510 to be operated. As illustrated in FIG. 1, the operation part 10 is rotated in the direction A and set to the position L (left mirror) or R (right mirror).

For example, the operation part 10 (the knob 11 and the cap 12) is rotated counterclockwise and set to the position L (left mirror). The rod 14 and the rotor 16 rotate in association with the rotation of the operation part 10. The rotation of this rotor 16 causes the cam portion 16*h* of the rotor 16 to move the switching pusher 100A downward. As a result, the contact plate 70*e* of the contact rubber 70 corresponding to the switching pusher 100A comes into contact with the contacts 61A, 61C, bringing the contacts 61A, 61C into conduction.

Similarly, when the operation part 10 is rotated clockwise and set to the position R (right mirror), the rod 14 and the rotor 16 rotate in association with the rotation of the operation part 10. The rotation of this rotor 16 causes the cam portion 16*h* of the rotor 16 to move the switching pusher 100B downward. As a result, the contact plate 70*e* of the contact rubber 70 corresponding to the switching pusher 100B comes into contact with the contacts 61B, 61D, bringing the contacts 61B, 61D into conduction.

(Action by Tilt Operation of Switch Device 1)

The tilt operation of the operation part 10 is to tilt a selected mirror, which is the left mirror 500 or the right mirror 510. The following describes an example in which the operation part 10 is rotated counterclockwise, set to the position L (left mirror) to select the left mirror 500, and the left mirror 500 is tilted in the direction U (up).

The left mirror 500 is selected, and therefore the contacts 61A, 61C are in conduction in FIG. 5.

The tilt operation of the operation part 10 (the knob 11 and the cap 12) in the direction U (up) causes the spherical surface portion 14*b* of the rod 14 to rotate on the receiving surface portion 16*f* of the rotor 16. As a result, the operation part 10, the actuator 13, and the rod 14 integrally tilt. This tilt operation causes the push projection portion 13*b* at the tilted position of the actuator 13 to move the corresponding tilting pusher 200C downward. As a result, the contact plate 70*e* of the contact rubber 70 corresponding to the tilting pusher 200C comes into contact with the contact 62C, bringing the contact 62C into conduction. Further, this tilt operation causes the push projection portion 13*b* to move the tilting pusher 200M2 downward. As a result, the contact plate 70*e* of the contact rubber 70 corresponding to the tilting pusher 200M2 comes into contact with the contact 64, bringing the contact 64 into conduction.

From the above, with reference to the circuit diagram illustrated in FIG. 5, the contacts 61A, 62C, and 64 are brought into conduction, and thus the motor 410 of the left mirror 500 is driven, allowing a mirror adjustment in the direction U (up).

By a similar action, the tilt operation of the operation part 10 in the direction LW (down) brings the contacts 61A, 62D, and 63 into conduction, and thus the motor 410 of the left mirror 500 is driven, allowing a mirror adjustment in the direction LW (down).

That is, in the tilt operation in the direction U (up) and the tilt operation in the direction LW (down) of the operation part 10, a current flows in a reverse direction through the motor 410, allowing the mirror adjustment in the direction U (up) or the direction LW (down) by the motor 410 of the left mirror 500.

Similarly, the tilt operation in the direction R (right) or the direction L (left) of the operation part 10 allows the mirror adjustment in the direction R (right) or the direction L (left) by the motor 420 of the left mirror 500.

When the right mirror 510 is selected as well, the mirror adjustments can be made in the four directions (crisscross direction) including the direction R (right), the direction L (left), the direction U (up), and the direction LW (down).

As illustrated in FIG. 4, an LED light source, for example, can be mounted in a position denoted by 65 to introduce light to the upper surface 12*a* of the cap 12 via the contact rubber 70 and the rod 14 having transparency, and illuminate the arrows, letters, and the like displayed on the upper surface 12*a* of the cap 12.

Second Embodiment

Figure 6:
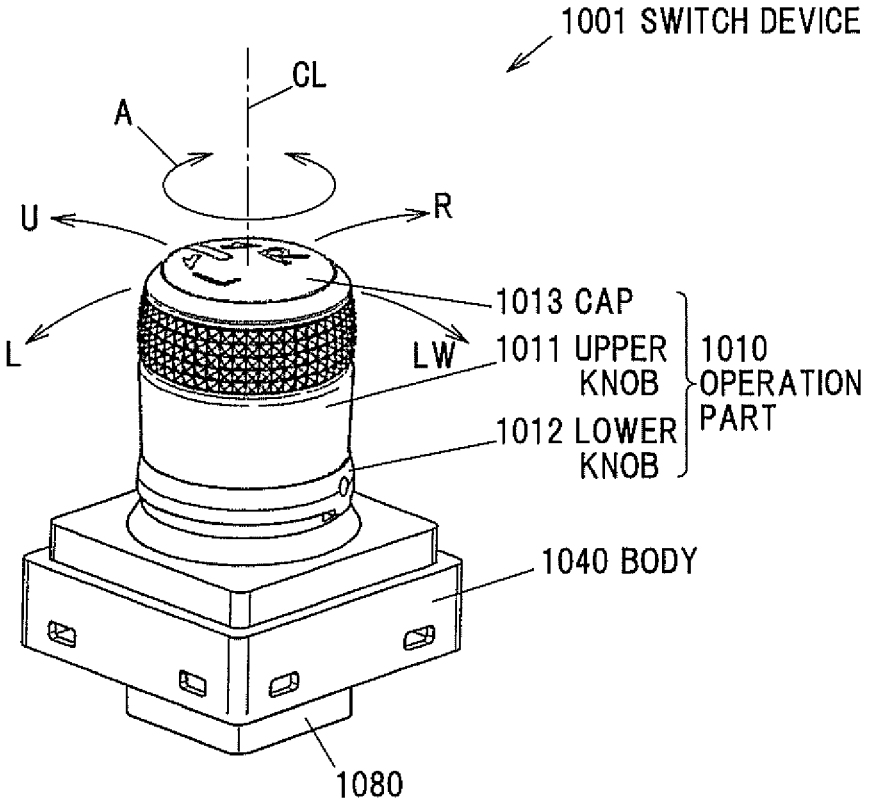
FIG. 6 is an overall perspective view of a switch device according to a second embodiment of the present invention.
Figure 7:
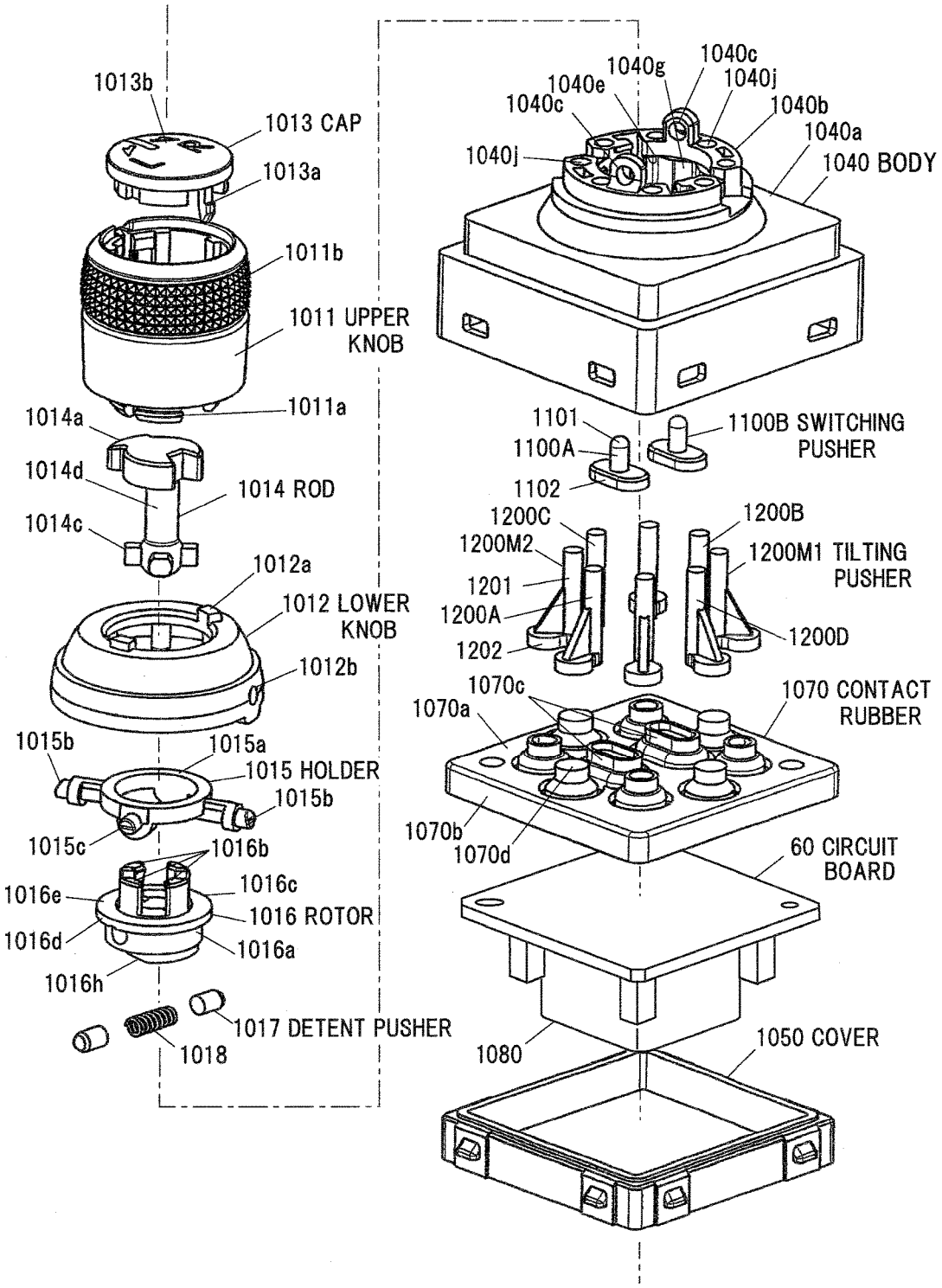
FIG. 7 is an exploded perspective view of the switch device according to the second embodiment of the present invention.
Figure 8:
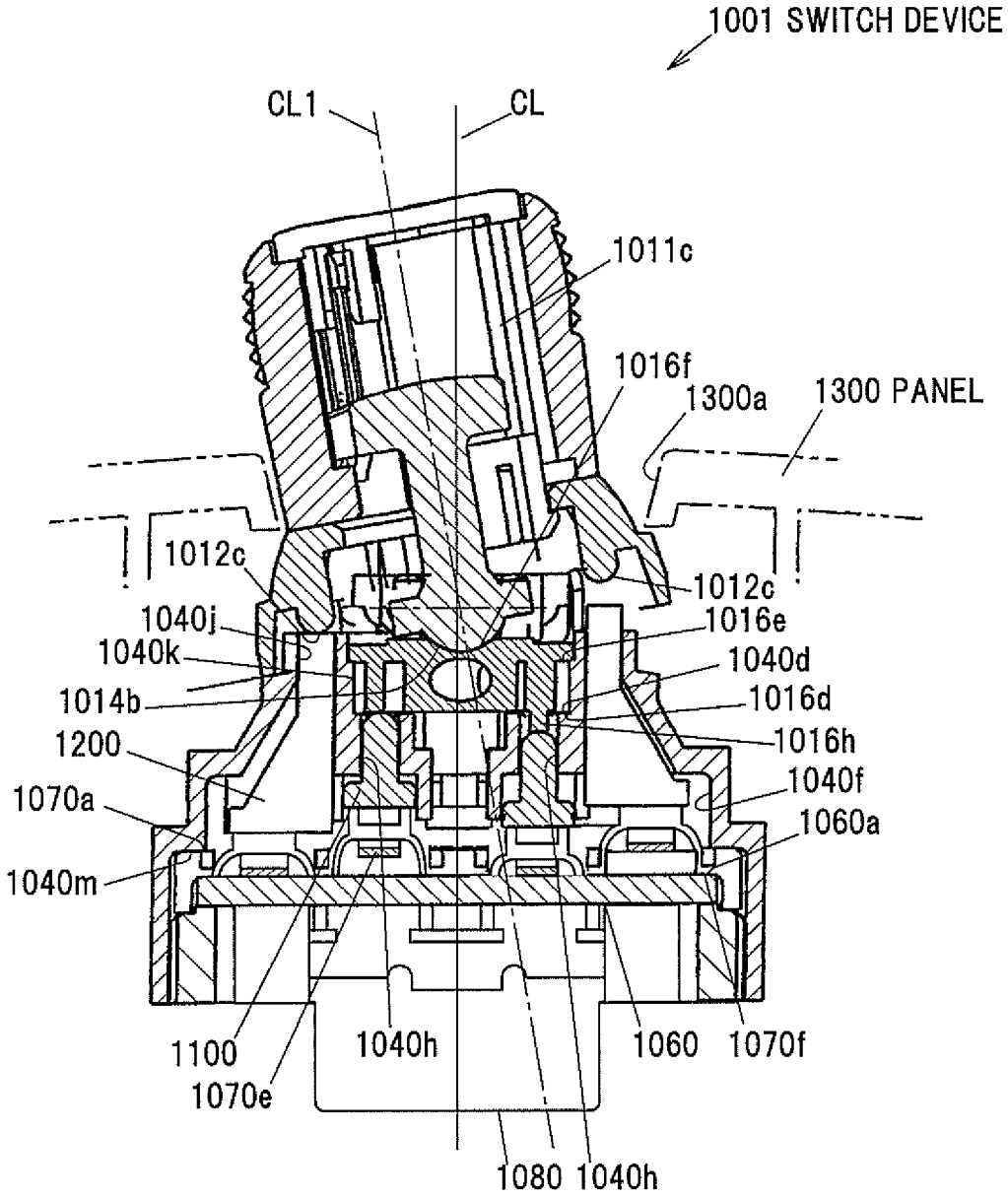
FIG. 8 is a longitudinal cross-sectional view of the switch device, including the operational axis CL, according to the second embodiment of the present invention.

FIG. 6 is an overall perspective view of a switch device according to a second embodiment of the present invention. FIG. 7 is an exploded perspective view of the switch device according to the second embodiment of the present invention. Further, FIG. 8 is a longitudinal cross-sectional view of the switch device, including the operational axis CL, according to the second embodiment of the present invention. A switch device 1001 according to the second embodiment of the present invention includes a first push mechanism that, by a rotation operation of an operation part 1010, selects and activates a first push switch part; a second push mechanism that, by a tilt operation of the operation part 1010, activates a second push switch part; the circuit board 60 having the first push switch part and the second push switch part mounted thereto; and a contact rubber 1070 that is interposed between the circuit board 60 and switching pushers 1100 as well as tilting pushers 1200 includes contacts corresponding to each of the switches, and is configured to cause a switch action upon each of the contacts coming into and out of contact with the corresponding switch by a movement of the switching pusher 1100 or the tilting pusher 1200. The contact rubber 1070 is formed so as to cover the entire upper surface of the circuit board 60.

The switch device 1001 according to the second embodiment of the present invention selects an operation target device by the first push switch part on the basis of the rotation operation of the operation part 1010, and operates the selected device by the operation of the second push switch part on the basis of the tilt operation of the operation part 1010, allowing switching by the rotation operation and a switch operation in the crisscross direction by the tilt operation through the use of a single operation knob. Further, the first push switch part and the second push switch part are not of the sliding type and are configured to be pushed by a pusher to bring contacts provided to the contact rubber 1070 into and out of contact to perform a switch action, resulting in excellent operability. Further, the contact rubber 1070 is formed so as to cover the entire upper surface of the circuit board 60, resulting in excellent waterproofness.

The following describes the switch device 1001, which is based on a mechanism that differs from that of the first embodiment of the present invention. The contents of FIGS. 4 and 5 are the same as those of the first embodiment. The following describes the configurations that differ from those of FIG. 1, which are illustrated in FIGS. 6 to 8.

(Operation Part 1010)

The operation part 1010 outwardly includes an upper knob 1011, a lower knob 1012, a cap 1013, and the like, as illustrated in FIG. 6. Further, as illustrated in FIG. 7, in the operation part 1010, a rod 1014, a holder 1015, a rotor 1016, and the like for transmitting a movement of the upper knob 1011 are provided.

In the operation part 1010, the upper knob 1011 and the cap 1013 contribute to the rotation operation around the operational axis CL illustrated in FIG. 6, and the upper knob 1011, the cap 1013, and the lower knob 1012 contribute to the tilt operation in the crisscross direction (the direction R (right), the direction L (left), the direction U (up), and the direction LW (down)) with respect to the operational axis CL.

The upper knob 1011, the lower knob 1012, and the cap 1013 are, for example, formed of resin, metal, or the like.

(Upper Knob 1011)

The upper knob 1011 and the cap 1013 are fixed to each other by a locking portion (not illustrated) located in the cylindrical portion of the upper knob 1011 being engaged with a pawl portion 1013*a* of the cap 1013. Further, an engaging projection portion 1011*a* of the upper knob 1011 is engaged with an engaging hook portion 1012*a* of the lower knob 1012, thereby rotatably fitting the upper knob 1011 and the lower knob 1012 together. This configuration allows the upper knob 1011 and the cap 1013 integrally fitted together to be gripped by fingers or the like and rotated around the operational axis CL with respect to the lower knob 1012, a body 1040 described later, and the like as illustrated in FIG. 6.

Further, the upper knob 1011, the lower knob 1012, and the cap 1013 that have been integrally gripped by fingers or the like are tilted in the crisscross direction (the direction R (right), the direction L (left), the direction U (up), and the direction LW (down)) with respect to the operational axis CL as illustrated in FIG. 6, with respect to the body 1040 and the like.

Further, a portion 1011*b* knurled by knurling is formed on a cylindrical portion of the substantially cylindrical upper knob 1011 as a slip stopper for facilitating the rotation operation and the like when the upper knob 1011 is gripped.

(Cap 1013)

The rotation direction corresponding to the operation direction of this switch device 1001 is indicated by arrows and letters 'L' and 'R' on an upper surface 1013*b* of the cap 1013. Note that these arrows, letters, and the like are written in white against a background print, allowing the arrows, letters, and the like to be illuminated by light irradiated from below.

(Lower Knob 1012)

The lower knob 1012 has a substantially cylindrical shape in which support holes 1012*b* are formed to face each other (180° apart from each other in the cylindrical portion). The support holes 1012*b* support the holder 1015 described later at both ends of the holder 1015. The lower knob 1012, as described above, functions as an operation part in the tilt operation rather than an operation part in the rotation operation.

As illustrated in FIGS. 7 and 8, the lower knob 1012 is pivotably supported by the holder 1015 about the support holes 1012*b*. Further, the lower knob 1012 is pivotably supported along with the holder 1015 that is pivotably supported about support holes 1040*c* of the body 1040. This configuration allows the lower knob 1012 to be tilted in the crisscross direction (the direction R (right), the direction L (left), the direction U (up), and the direction LW (down)) with respect to the operational axis CL as illustrated in FIG. 6.

Here, a projection portion 1012*c* that pushes the tilting pusher 1200 described later downward during the tilt operation is formed at the lower end of the lower knob 1012 as illustrated in FIG. 8. A plurality of the projection portions 1012*c* are provided in correspondence with the tilting pushers 1200.

(Rod 1014)

The rod 1014 includes, on the upper portion thereof, a fitting portion 1014*a* that is slidable and integrally rotates with an inner groove portion 1011*c* of the upper knob 1011 in the rotation direction A illustrated in FIG. 6. The rod 1014 includes, on the lower portion thereof, a spherical surface portion 1014*b* that is in contact with the rotor 1016 described later, and a projection portion 1014*c* that is fitted together and integrally rotate with the rotor 1016. The fitting portion 1014*a*, the spherical surface portion 1014*b*, and the projection portion 1014*c* is connected and integrated by a column-shaped rod portion 1014*d*. Note that, while this rod 1014 is formed of resin or the like, formation by transparent resin allows the above-described arrows, letters, and the like to be illuminated by light, such as light from an LED positioned on a lower side, introduced to the upper surface 1013*b* of the cap 1013.

(Holder 1015)

The holder 1015 is, for example, formed of resin, metal, or the like, rotatably connected in a first direction to the lower knob 1012, and rotatably connected in a second direction to the body 1040 described later. The first direction and the second direction described above are orthogonal to each other. This configuration allows the lower knob 1012, that is, the integrally configured upper knob 1011, lower knob 1012, and cap 1013, to be tilted in a direction orthogonal to the body 1040. That is, the lower knob 1012 can be tilted in the four directions of the direction R (right), the direction L (left), the direction U (up), and the direction LW (down) illustrated in FIG. 6.

The holder 1015 includes an annular portion 1015*a*, fitting portions 1015*b* formed to protrude outward from positions on the annular portion 1015*a* 180° apart from each other, and fitting portions 1015*c* formed to protrude outward in a direction orthogonal to the direction in which the fitting portions 1015*b* protrude.

Tip end portions of the fitting portions 1015*b* rotatably fit together with the support holes 1012*b* of the lower knob 1012. This configuration allows the lower knob 1012 to be tilted in the direction R (right) and the direction L (left) illustrated in FIG. 6. On the other hand, the fitting portions 1015*c* rotatably fit together with the support holes 1040*c* of the body 1040. This configuration allows the lower knob 1012 to be tilted in the direction U (up) and the direction LW (down) illustrated in FIG. 6.

(Rotor 1016)

The rotor 1016 is, for example, formed of resin, metal, or the like and includes a substantially cylindrical main body portion 1016*a*, and an engaging projection portion 1016*b* that protrudes from this main body portion 1016*a* in a direction in which the cylindrical main body portion 1016*a* extends.

The engaging projection portion 1016*b* engages with the projection portion 1014*c* of the rod 1014 in the rotation direction. This configuration allows the rotation by the rotation operation of the upper knob 1011 to be transmitted to the rotor 1016 via the rod 1014. Note that the engaging projection portion 1016*b* of the rotor 1016 and the projection portion 1014*c* of the rod 1014 are not regulated in terms of movement in the vertical direction, allowing movement in the vertical direction (slight movement) during the tilt action.

A flange portion 1016*c* is provided to the main body portion 1016*a*, and a lower surface end 1016*d* of this flange portion 1016*c* comes into contact with a lower stage portion 1040*d* of the body 1040, thereby positioning the rotor 1016 in the vertical direction as illustrated in FIGS. 7 and 8. Further, an upper surface end 1016*e* of the flange portion 1016*a* comes into contact with an upper stage portion 1040*e* of the body 1040, thereby preventing the rotor 1016 from separating upward and locking the rotor 1016. This configuration causes the rotor 1016 to be positioned in the vertical direction and rotatably supported with respect to the body 1040.

A cam portion 1016*h* formed in a cam shape to protrude downward is provided on a lower end surface of the main body portion 1016*a*. A lower surface of this cam portion 1016*h* is in contact with upper end portions of switching pushers 1100 described later, and has the function of moving one of the switching pushers 1100 (1100A, 1100B) downward in response to the rotation of the rotor 1016.

As illustrated in FIG. 8, a receiving surface portion 1016*f* that receives the spherical surface portion 1014*b* of the rod 1014 is formed on an upper surface of the main body portion 1016*a*. This receiving surface portion 1016*f* is formed in a concave spherical surface shape corresponding to the spherical surface portion 1014*b* of the rod 1014. This configuration allows the upper knob 1011, the lower knob 1012, the cap 1013, and the rod 1014 to be moved in any tilt direction (a direction CL1, for example) such as illustrated in FIG. 8. However, as previously mentioned, the tilt operation can be performed only in the four directions (crisscross direction) including the direction R (right), direction L (left), direction U (up), and direction LW (down) illustrated in FIG. 6 due to the supported directions of the holder 1015 and the lower knob 1012, and the holder 1015 and the body 1040.

(Body 1040)

The body 1040 is formed of resin, metal, or the like, and includes a box-shaped main body portion 1040*a* having a space portion 1040*f* that houses the circuit board 60, the contact rubber 1070, the switching pushers 1100, the tilting pushers 1200, and the like, and a support portion 1040*b* that is formed on the main body portion 1040*a* and pivotably supports the holder 1015.

As illustrated in FIGS. 7 and 8, the support holes 1040*c* are formed on the support portion 1040*b*, the fitting portions 1015*c* of the holder 1015 being rotatably fitted together and supported with the support holes 1040*c*. Further, a fitting hole 1040*k*, with which the main body portion 1016*a* of the rotor 1016 is rotatably fitted, is formed in the support portion 1040*b*. Further, the body 1040 also includes, formed therein, the lower stage portion 1040*d* that comes into contact with the lower surface end 1016*d* of the flange portion 1016*c* of the rotor 1016, and the upper stage portion 1040*e* that comes into contact with the upper surface end 1016*e* to prevent the rotor 1016 from separating upward and to lock the rotor 1016.

Further, as illustrated in FIG. 7, a detent groove 1040*g* is formed in a portion of the fitting hole 1040*k*, and is configured so that detent pushers 1017 that are mounted on the rotor 1016 and biased by a spring 1018 to protrude from the main body portion 1016*a* come into contact with the detent groove 1040*g*, thereby generating a detent feeling.

Furthermore, guide holes 1040*h*, 1040*j* are formed extending in the direction of the operational axis CL through the support portion 1040*b*. The guide holes 1040*h* are configured to guide the switching pushers 1100 described later, and the guide holes 1040*j* are configured to guide the tilting pushers 1200.

Further, as illustrated in FIGS. 7 and 8, the circuit board 60 and the contact rubber 1070 are housed in the space portion 1040*f* of the main body portion 1040*a*, and fixed by a cover 1050 from below. The upper surface 60*a* of the circuit board 60 and an inner ceiling portion 1070*f* of the contact rubber 1070 come into contact with each other, and the circuit board 60 and the contact rubber 1070 are pressed and fixed by the cover 1050 from below with an upper surface portion 1070*a* of the contact rubber 1070 in contact with an inner stage portion 1040*m* of the space portion 1040*f*.

(First Push Mechanism)

The first push mechanism is a mechanism that, by the rotation operation of the operation part 1010, selects and activates the first push switch part. The first push mechanism includes the operation part 1010 (the upper knob 1011, and the cap 1013), the rod 1014, the rotor 1016, the switching pushers 1100, and the like described above. Here, the first push switch part is a contact pattern formed on the circuit board 60 described later. The contact pattern is configured to be on/off on the basis of the rotation operation.

The switching pushers 1100 (1100A, 1100B) each include a shaft portion 1101, and a push operation portion 10102 that pushes the first push switch part via the contact rubber 1070. The shaft portions 1101 are slidably guided by the guide holes 1040*h* of the body 1040. The switching pushers 1100 (1100A, 1100B) are biased toward the rotor 1016 by the elastic force of the contact rubber 1070. The switching pusher 1100A or 1100B is pushed toward the circuit board 60 against the elastic force of the contact rubber 1070 by the cam portion 1016*h* of the rotor 1016 in response to the rotation operation of the operation part 1010.

(Second Push Mechanism)

The second push mechanism is a mechanism that, by the tilt operation of the operation part 1010 (the upper knob 1011, the lower knob 1012, and the cap 1013), selects and activates the second push switch part. The second push mechanism includes the operation part 1010, the rod 1014, the holder 1015, the tilting pushers 1200, and the like described above. Here, the second push switch part is a contact pattern formed on the circuit board 60 described later. The contact pattern is configured to be on/off on the basis of the tilt operation.

The tilting pushers 1200 (1200A, 1200B, 1200C, 1200D, 1200M1, 1200M2) each include a shaft portion 1201, and a push operation part 1202 that pushes the second push switch part via the contact rubber 1070. The shaft portions 1201 are slidably guided by guide holes 1040*j* of the body 1040. The tilting pushers 1200 (1200A, 1200B, 1200C, 1200D, 1200M1, 1200M2) are biased toward the lower knob 1012 by the elastic force of the contact rubber 1070. The tilting pushers 1200 (1200A, 1200B, 1200C, 1200D, 1200M1, 1200M2) are pushed toward the circuit board 60 against the elastic force of the contact rubber 1070 by each of the projection portions 1012*c* of the lower knob 1012 in response to the tilt operation of the operation part 1010.

(Circuit Board 60)

The circuit board 60 of the switch device according to the second embodiment of the present invention is the same as that of the first embodiment illustrated in FIG. 4, and a description thereof will be omitted.

The first push switch part is a contact pattern formed on the circuit board 60. The contact pattern is configured to be on/off on the basis of the rotation operation. As illustrated in FIG. 4, the first push switch part includes the contacts 61A, 61B, 61C, 61D formed on the circuit board 60. The contacts (61A, 61B, 61C, 61D) corresponding to this first push mechanism are disposed between two or more contacts (62A, 62B, 62C, 62D, 63, 64) corresponding to the second push mechanism described later. Here, each of the contacts 61A, 61B, 61C, 61D is brought into conduction and switched on by a contact plate 1070*e* of the contact rubber 1070, which is positioned over the corresponding contact, being pushed by the switching pusher 1100 (1100A, 1100B).

The second push switch part is a contact pattern formed on the circuit board 60. The contact pattern is configured to be on/off on the basis of the tilt operation. As illustrated in FIG. 4, the second push switch part includes the contacts 62A, 62B, 62C, 62D, 63, 64 formed on the circuit board 60. Here, each of the contacts 62A, 62B, 62C, 62D, 63, 64 is brought into conduction and switched on by the contact plate 1070*e* of the contact rubber 1070, which is positioned over the corresponding contact, being pushed by the tilting pusher 1200 (1200A, 1200B, 1200C, 1200D, 1200M1, 1200M2).

(Contact Rubber 1070)

The contact rubber 1070 is formed of an elastomer (rubber) such as silicone, on which the upper surface portion 1070*a*, side surface portions 1070*b*, and dome portions 1070*c*, 1070*d* formed in a convex shape in correspondence with the first push switch part and the second push switch part are integrally formed. This contact rubber 1070, as illustrated in FIG. 8, is mounted so as to cover the circuit board 60 with the upper surface portion 1070*a* and the dome portions 1070*c*, 1070*d*, and enclose all side surfaces of the circuit board 60 with the side surface portions 1070*b*. The dome portions 1070*c*, 1070*d* are formed corresponding to the switching pushers 1100 (100A, 100B) and the tilting pushers 1200 (1200A, 1200B, 1200C, 1200D, 1200M1, 1200M2), and bias each of the pushers by the elastic force of the rubber toward the operation part 1010, resulting in resistance against the push action.

As illustrated in FIG. 8, the conductive contact plates 1070*e* are each mounted on the lower end portion of each of the dome portions. Thus, each of the pushers moves downward by the rotation operation or the tilt operation to cause the contact plate 1070*e* to come into contact with the corresponding contact (61A, 61B, 61C, 61D, 62A, 62B, 62C, 62D, 63, 64) positioned on the circuit board 60, bringing the contact into conduction and causing the on action of the switch to be performed.

(Switch Circuit)

The switch circuit of the first embodiment illustrated in FIG. 5 is the same as that of the second embodiment of the present invention, and a description thereof will be omitted.

(Action by Rotation Operation of Switch Device 1001)

The rotation operation of the operation part 1010 is to select one of the left mirror 500 and the right mirror 510 to be operated. As illustrated in FIG. 6, the operation part 1010 is rotated in the direction A and set to the position L (left mirror) or R (right mirror).

For example, the operation part 1010 (the upper knob 1011, and the cap 1013) is rotated counterclockwise and set to the position L (left mirror). The rod 1014 and the rotor 1016 rotate in association with the rotation of the operation part 1010. The rotation of this rotor 1016 causes the cam portion 1016*h* of the rotor 1016 to move the switching pusher 100A downward. As a result, the contact plate 1070*e* of the contact rubber 1070 corresponding to the switching pusher 11100A comes into contact with the contacts 61A, 61C, bringing the contacts 61A, 61C into conduction.

Similarly, when the operation part 1010 is rotated clockwise and set to the position R (right mirror), the rod 1014 and the rotor 1016 rotate in association with the rotation of the operation part 1010. The rotation of this rotor 1016 causes the cam portion 1016*h* of the rotor 1016 to move the switching pusher 1100B downward. As a result, the contact plate 1070*e* of the contact rubber 1070 corresponding to the switching pusher 1100B comes into contact with the contacts 61B, 61D, bringing the contacts 61B, 61D into conduction.

(Action by Tilt Operation of Switch Device 1001)

The tilt operation of the operation part 1010 is to tilt a selected mirror, which is the left mirror 500 or the right mirror 510. The following describes an example in which the operation part 1010 is rotated counterclockwise and set to the position L (left mirror) to select the left mirror 500, and the left mirror 500 is tilted in the direction U (up).

The left mirror 500 is selected, and therefore the contacts 61A, 61C are in conduction in FIG. 5.

The tilt operation in the direction U (up) of the operation part 1010 (the upper knob 1011, the lower knob 1012, and the cap 1013) tilts the operation part 1010 with the fitting portions 1015*c* of the holder 1015 rotatably fitted together with the support holes 1040*c* of the body 1040. This tilt operation causes the projection portions 1012*c* of the lower knob 1012 to move the tilting pusher 1200C downward. As a result, the contact plate 1070*e* of the contact rubber 1070 corresponding to the tilting pusher 1200C comes into contact with the contact 62C, bringing the contact 62C into conduction. This tilt operation causes the projection portions 1012*c* of the lower knob 1012 to move the tilting pusher 1200M2 downward. As a result, the contact plate 1070*e* of the contact rubber 1070 corresponding to the tilting pusher 1200M2 comes into contact with the contact 64, bringing the contact 64 into conduction.

From the above, with reference to the circuit diagram illustrated in FIG. 5, the contacts 61A, 62C, and 64 are brought into conduction, and thus the motor 410 of the left mirror 500 is driven, allowing the mirror adjustment in the direction U (up).

By a similar action, the tilt operation of the operation part 1010 in the direction LW (down) brings the contacts 61A, 62D, and 63 into conduction, and thus the motor 410 of the left mirror 500 is driven, allowing the mirror adjustment in the direction LW (down).

That is, with the tilt operation in the direction U (up) and the tilt operation in the direction LW (down) of the operation part 1010, a current flows in a reverse direction through the motor 410, allowing the mirror adjustment in the direction U (up) or the direction LW (down) by the motor 410 of the left mirror 500.

Similarly, the tilt operation in the direction R (right) or the direction L (left) of the operation part 1010 allows a mirror adjustment in the direction R (right) or the direction L (left) by the motor 420 of the left mirror 500.

When the right mirror 510 is selected as well, mirror adjustments can be made in the four directions (crisscross direction) including the direction R (right), the direction L (left), the direction U (up), and the direction LW (down).

As illustrated in FIG. 4, an LED light source, for example, can be mounted in a position denoted by 65 to introduce light to the upper surface 1013*b* of the cap 1013 via the contact rubber 1070 and the rod 1014 having transparency, and illuminate the arrows, letters, and the like displayed on the upper surface 1013*b* of the cap 1013.

Effects of the Embodiments

According to the switch device of the embodiments of the present invention, the following effects are achieved:

(1) The switch device selects an operation target device by the first push switch part on the basis of the rotation operation of the operation part, and operates the selected device by the operation of the second push switch part on the basis of the tilt operation of the operation part, allowing switching by the rotation operation and a switch operation in the crisscross direction by the tilt operation through the use of a single operation knob.

(2) Further, the first push switch part and the second push switch part are not of the sliding type and are configured to be pushed by a pusher to bring the contacts provided to the contact rubber in and out of contact to perform a switch action. This configuration allows the switch device to provide favorable operability and an excellent operational feel without the effects of sliding resistance.

(3) Further, the contact rubber is mounted so as to cover the entire upper surface of the circuit board. Alternatively, the contact rubber is mounted so as to enclose all side surfaces of the circuit board. This configuration allows the switch device to have excellent waterproofness.

(4) Further, as illustrated in the other embodiment, an LED light source, for example, can be mounted on the circuit board to introduce light to the upper surface of the cap 12 via the contact rubber and the rod having transparency, and illuminate the arrows, letters, and the like displayed on the upper surface of the cap 12. This configuration makes it possible to maintain the waterproofness of the circuit board by the contact rubber and illuminate the arrows, letters, and the like on the operation part from a light source on the circuit board.

Although several embodiments of the present invention have been described above, these embodiments are merely examples and the invention according to claims is not to be limited thereto. Such novel embodiments may be implemented in various other forms, and various omissions, substitutions, changes, and the like can be made without departing from the spirit and scope of the present invention. In addition, all the combinations of the features described in these embodiments are not necessarily needed to solve the technical problem.

Further, these embodiments are included within the spirit and scope of the invention and also within the invention described in the claims and the scope of equivalents thereof.

What is claimed is:

1. A switch device, comprising:

an operation part;

a first push mechanism that, by a rotation operation of the operation part, selects and activates a first push switch part;

a second push mechanism that, by a tilt operation of the operation part, activates a second push switch part;

a circuit board comprising the first push switch part and the second push switch part mounted thereto; and a contact rubber interposed between the circuit board and the first and second push mechanisms, wherein the contact rubber includes contacts corresponding to the first push switch part and the second push switch part and is configured such that the contacts contact with or separate from the corresponding switch parts by a movement of the first push mechanism and the second push mechanism, wherein the contact rubber is formed so as to cover an entire upper surface of the circuit board, and wherein the contacts corresponding to the first push mechanism are disposed between the contacts corresponding to the second push mechanism in a plane of the circuit board.

2. The switch device according to claim 1, wherein the first push mechanism or the second push mechanism comprises a pusher that transmits a movement of the rotation operation or the tilt operation of the operation part as a push action to the circuit board.

3. The switch device according to claim 2, wherein the pusher comprises a plurality of pushers, and wherein the contact rubber comprises a plurality of dome portions corresponding to the plurality of pushers so as to provide a resistance against the push action.

4. The switch device according to claim 1, wherein the first push mechanism, by a rotation movement of a rod and a rotor caused by the rotation operation of the operation part, pushes a switching pusher via a cam portion of the rotor to move the switching pusher toward the circuit board, and wherein the second push mechanism, by a tilt movement of the rod and an actuator caused by the tilt operation of the operation part, pushes a tilting pusher to move the tilting pusher toward the circuit board.

5. The switch device according to claim 1, wherein the contact rubber is formed so as to cover an entire side surface of the circuit board.

6. The switch device according to claim 1, wherein the circuit board further comprises a light source, and wherein the contact rubber comprises a transparent rubber for transmitting therethrough a light emitted from the light source.

* * * * *